US006880295B2

(12) United States Patent
Frey

(10) Patent No.: US 6,880,295 B2
(45) Date of Patent: Apr. 19, 2005

(54) SNAP LOCK DEVICE FOR HINGEDLY SECURING AN EXTENSION TO A DOWNSPOUT

(76) Inventor: Scott Frey, N. 1248 Gastron Rd., Lodi, WI (US) 53555

( * ) Notice: Subject to any disclaimer, the term of this patent is extended or adjusted under 35 U.S.C. 154(b) by 13 days.

(21) Appl. No.: 10/001,310

(22) Filed: Nov. 23, 2001

(65) Prior Publication Data

US 2002/0095876 A1 Jul. 25, 2002

Related U.S. Application Data

(60) Provisional application No. 60/252,973, filed on Nov. 24, 2000.

(51) Int. Cl.[7] ..... E04D 13/08

(52) U.S. Cl. ..... 52/16; 137/615; 405/52; 405/121; 411/324; 411/339; 411/509; 411/913; 24/662

(58) Field of Search ..... 16/221, 225, 227

(56) References Cited

U.S. PATENT DOCUMENTS 3,665,800 A * 5/1972 Ryder ..... 85/5
3,911,954 A * 10/1975 Johnson
4,270,572 A * 6/1981 Jarzynka ..... 137/615
5,014,745 A * 5/1991 Watt ..... 137/615
5,511,829 A * 4/1996 Sicotte et al. ..... 285/176
5,658,092 A * 8/1997 Sweers ..... 405/118
5,673,519 A * 10/1997 McCaughan ..... 52/16
5,735,085 A * 4/1998 Denooy ..... 52/15
5,846,040 A * 12/1998 Ueno ..... 411/45
5,975,820 A * 11/1999 Kirchen ..... 411/339

* cited by examiner

*Primary Examiner*—Yvonne Michele Horton
(74) *Attorney, Agent, or Firm*—David J. Archer

(57) ABSTRACT

A snap lock device is disclosed for hingedly securing an extension to a downspout. The device includes a first member having a head and a shank extending from the head. The shank extends through a first hole defined by the extension and through a second hole defined by the downspout. A second member cooperates with the first member and the second member defines an aperture for the locking reception therein of the shank for locking the extension and downspout together.

2 Claims, 8 Drawing Sheets

SNAP LOCK DEVICE FOR HINGEDLY SECURING AN EXTENSION TO A DOWNSPOUT

CROSS REFERENCE TO RELATED APPLICATION

The present application is a Complete application which is based on an earlier filed Provisional application U.S. Ser. No. 60/252,973 filed Nov. 24th 2000. All of the disclosure of the aforementioned Provisional application is incorporated herein by reference.

BACKGROUND OF THE INVENTION

1. Field of the Invention

The present invention relates to a snap lock device for hingedly securing an extension to a downspout. More specifically, the present invention relates to a snap lock device for hingedly securing an extension to a downspout, the arrangement being such that folding of the extension against the downspout is permitted for facilitating yard maintenance.

2. Background Information

In the construction industry, houses are built with downspouts for channelling rain from the roof. A typical downspout will be provided with a curved portion or elbow at the base thereof for directing the rainwater away from the house.

Many owners have attached flexible pipes and the like to such curved portions of the downspouts so that the rainwater is taken further away from the house. Sometimes, instead of flexible piping, concrete channel blocks have been laid in order to serve the same purpose. However, a problem is encountered with the aforementioned prior art arrangements in that when mowing grass near the house such pipes or channel blocks prevent such mowing close to the house.

The present invention overcomes the aforementioned problem by the provision of a downspout extension which is hinged to the curved portion of the downspout so that when mowing close to the house, the extension is flipped up to provide ready access to the vicinity of the downspout. When the mowing operation is completed, the extension is pivoted down to a position in which the extension lies along the ground for conveying rain water away from the house.

Therefore, it is a primary feature of the present invention to provide a snap lock device for hingedly securing an extension to a downspout that overcomes the problems associated with the prior art arrangements.

Another feature of the present invention is the provision of a snap lock device for hingedly securing an extension to a downspout that enables the mowing grass close to a house.

A further feature of the present invention is the provision of a snap lock device for hingedly securing an extension to a downspout that is of relatively low cost.

Other features and advantages of the present invention will be readily apparent to those skilled in the art by a consideration of the detailed description of a preferred embodiment of the present invention contained herein.

SUMMARY OF THE INVENTION

The present invention relates to a snap lock device for hingedly securing an extension to a downspout. The device includes a first member having a head and a shank extending from the head. The shank extends through a first hole defined by the extension and through a second hole defined by the downspout. A second member cooperates with the first member and the second member defines an aperture for the locking reception therein of the shank for locking the extension and downspout together.

In a more specific embodiment of the present invention, the snap lock device further includes a third member, the third member having a further head and a further shank which extends from the further head. The further shank extends through a third hole spaced from the first hole and defined by the extension and through a fourth hole spaced from the second hole and defined by the downspout. A fourth member cooperates with the third member, the fourth member defining a further aperture for the locking reception therein of the further shank for locking the extension and downspout together. The arrangement is such that folding of the extension against the downspout is permitted for facilitating yard maintenance.

Also, the head is of disc shaped configuration and the head is metallic. More specifically, the head is fabricated from Aluminum.

Moreover, the shank is of cylindrical configuration. The cylindrical shank has a proximal and a distal end and a cylindrical surface, the shank extending normal to the head. Additionally, the shank has a diameter which is less than a further diameter of the head.

Furthermore, the cylindrical surface of the shank defines an annular ridge such that when the shank is extends through the aperture of the second member, the annular ridge locks the second member relative to the first member.

Additionally, the second member is of disc shaped configuration and is fabricated from a plastics material such as NYLON.

Moreover, the second member has a first diameter which is the same as the further diameter of the head.

The present invention also includes a tool device for attachment to a jaw of a pair of pliers for assisting fastening of a snap lock device of the aforementioned type. The tool device includes a cylindrical member having a first and a second face and a longitudinal axis and a cylindrical outer surface. The cylindrical member defines a coaxial bore which extends between the first and second face.

The first face defines a slot which extends diametrically across the first face for the reception therein of the jaw of the pair of pliers. Also, the cylindrical member defines a threaded bore which extends normal to the slot, the threaded bore extending from the cylindrical outer surface to the slot. A fastener cooperates with the threaded bore such that the fastener removably fastens the cylindrical member to the jaw of the pair of pliers.

Furthermore, the second face of the cylindrical member defines a cavity which is disposed coaxially relative to the longitudinal axis. The cavity has substantially the same dimensions as the second member. The arrangement is such that when a second member is disposed within the cavity, insertion of the shank within the aperture of the second member by the pliers is permitted.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

BRIEF DESCRIPTION OF THE DRAWINGS

Similar reference characters refer to similar parts throughout the various views of the present invention.

DETAILED DESCRIPTION OF THE DRAWINGS

Figure 1:
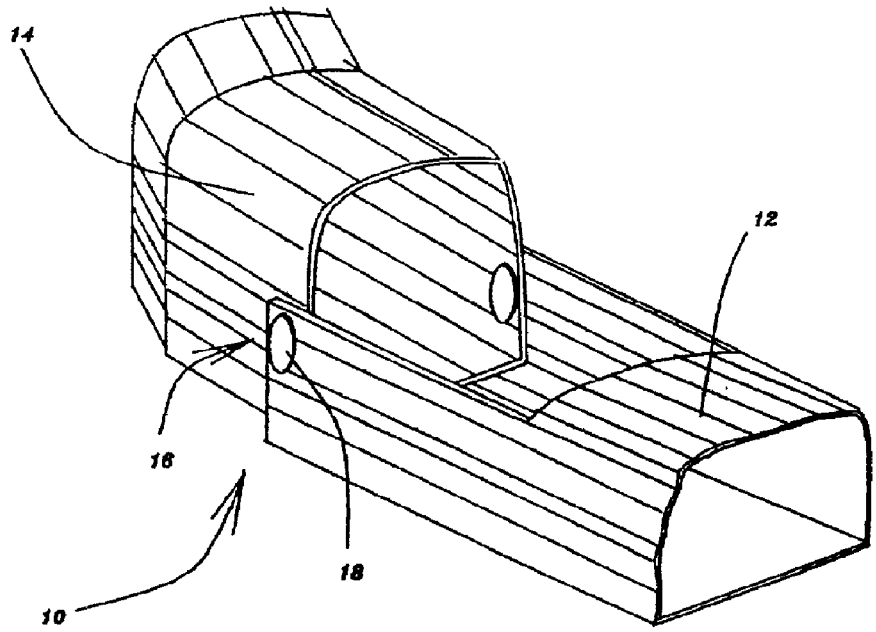
FIG. 1 is a perspective view showing a snap lock device according to the present invention.

FIG. 1 is a perspective view showing a snap lock device generally designated 10 according to the present invention for hingedly securing an extension 12 to a downspout 14. As shown in FIG. 1, the device 10 includes a first member generally designated 16 having a head 18.

Figure 2:
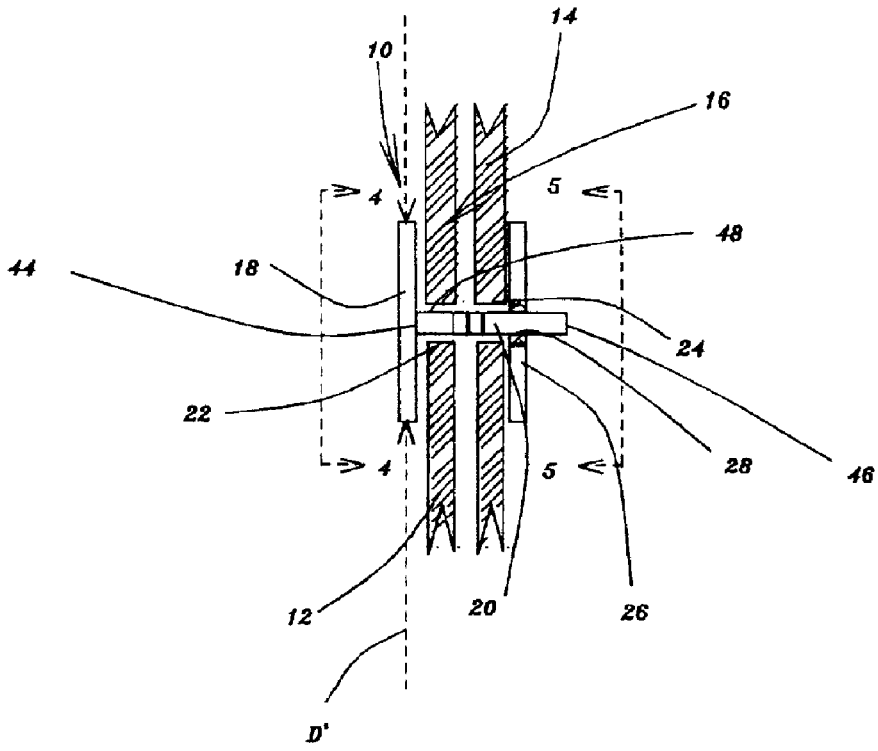
FIG. 2 is an enlarged side elevational view of the snap lock device shown in FIG. 1.

FIG. 2 is an enlarged side elevational view of the snap lock device 10 shown in FIG. 1. As shown in FIG. 2, a shank 20 extends from the head 18. The shank 20 extends through a first hole 22 defined by the extension 12 and through a second hole 24 defined by the downspout 14. A second member 26 cooperates with the first member 16 and the second member 26 defines an aperture 28 for the locking reception therein of the shank 20 for locking the extension 12 and downspout 14 together.

Figure 3:
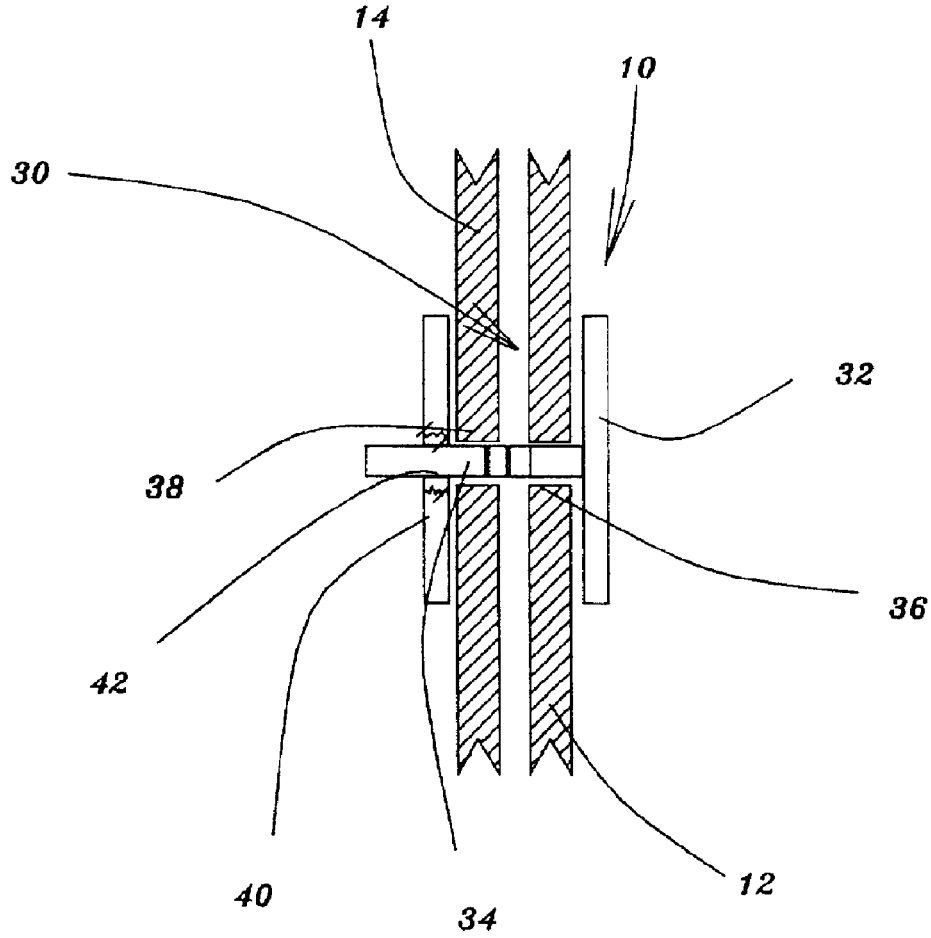
FIG. 3 is a similar view to the view shown in FIG. 2 but shows a third member.

FIG. 3 is a similar view to the view shown in FIG. 2 but shows a third member generally designated 30. As shown in FIG. 3, the third member 30 has a further head 32 and a further shank 34 which extends from the further head 32. The further shank 34 extends through a third hole 36 spaced from the first hole 22 and defined by the extension 12 and through a fourth hole 38 spaced from the second hole 24 and defined by the downspout 14. A fourth member 40 cooperates with the third member 30, the fourth member 40 defining a further aperture 42 for the locking reception therein of the further shank 34 for locking the extension 12 and downspout 14 together. The arrangement is such that upward folding of the extension 12 against the downspout 14 is permitted for facilitating yard maintenance. The third and fourth members 30 and 40 respectively are identical in construction to the first and second members 16 and 26 respectively.

Figure 4:
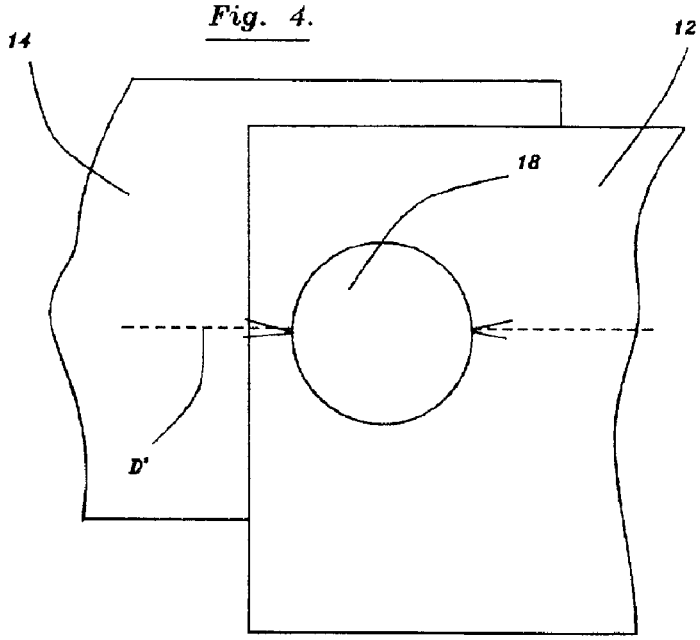
FIG. 4 is a view taken on the line 4—4 of FIG. 2.

FIG. 4 is a view taken on the line 4—4 of FIG. 2. As shown in FIG. 4 the head 18 is of disc shaped configuration and the head is metallic. More specifically, the head 18 is fabricated from Aluminum.

Figure 5:
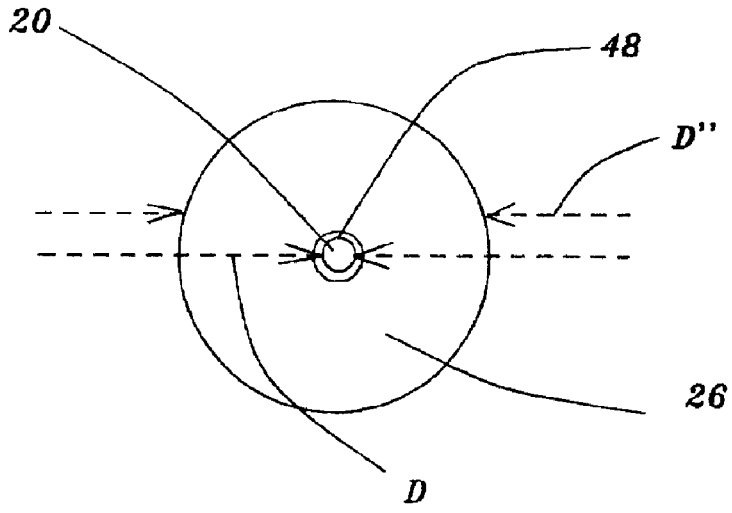
FIG. 5 is a view taken on the line 5—5 of FIG. 2.

FIG. 5 is a view taken on the line 5—5 of FIG. 2. As shown in FIGS. 2 and 5, the shank 20 is of cylindrical configuration. The cylindrical shank 20 has a proximal and a distal end 44 and 46 respectively and a cylindrical surface 48, the shank 20 extending normal to the head 18. Additionally, the shank 20 has a diameter D which is less than a further diameter D' of the head 18, as shown in FIG. 2.

Figure 6:
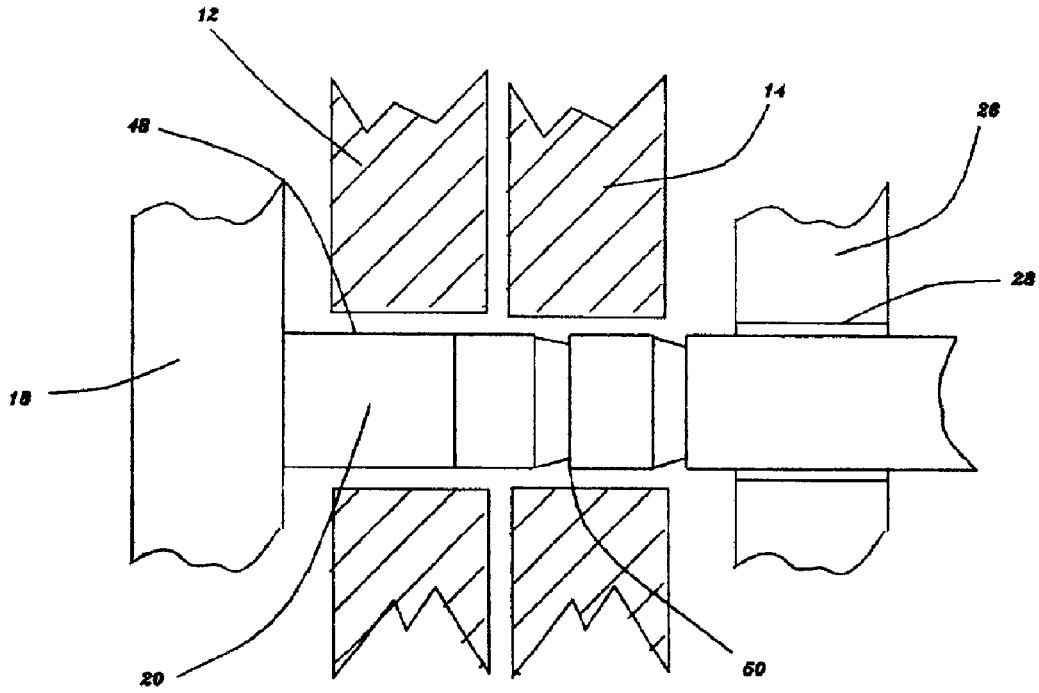
FIG. 6 is an enlarged fragmentary view of the shank shown in FIG. 2.

FIG. 6 is an enlarged fragmentary view of the shank 20 shown in FIG. 2. As shown in FIG. 6, the cylindrical surface 48 of the shank 20 defines an annular ridge 50 such that when the shank 20 extends through the aperture 28 of the second member 26, the annular ridge 50 locks the second member 26 relative to the first member 16. As shown in FIG. 6, more than one ridge 50 is provided.

As shown in FIG. 5, the second member 26 is of disc shaped configuration and is fabricated from a plastics material such as NYLON.

Moreover, the second member 26 has a first diameter D" which is the same as the further diameter D' of the head 18.

Figure 7:
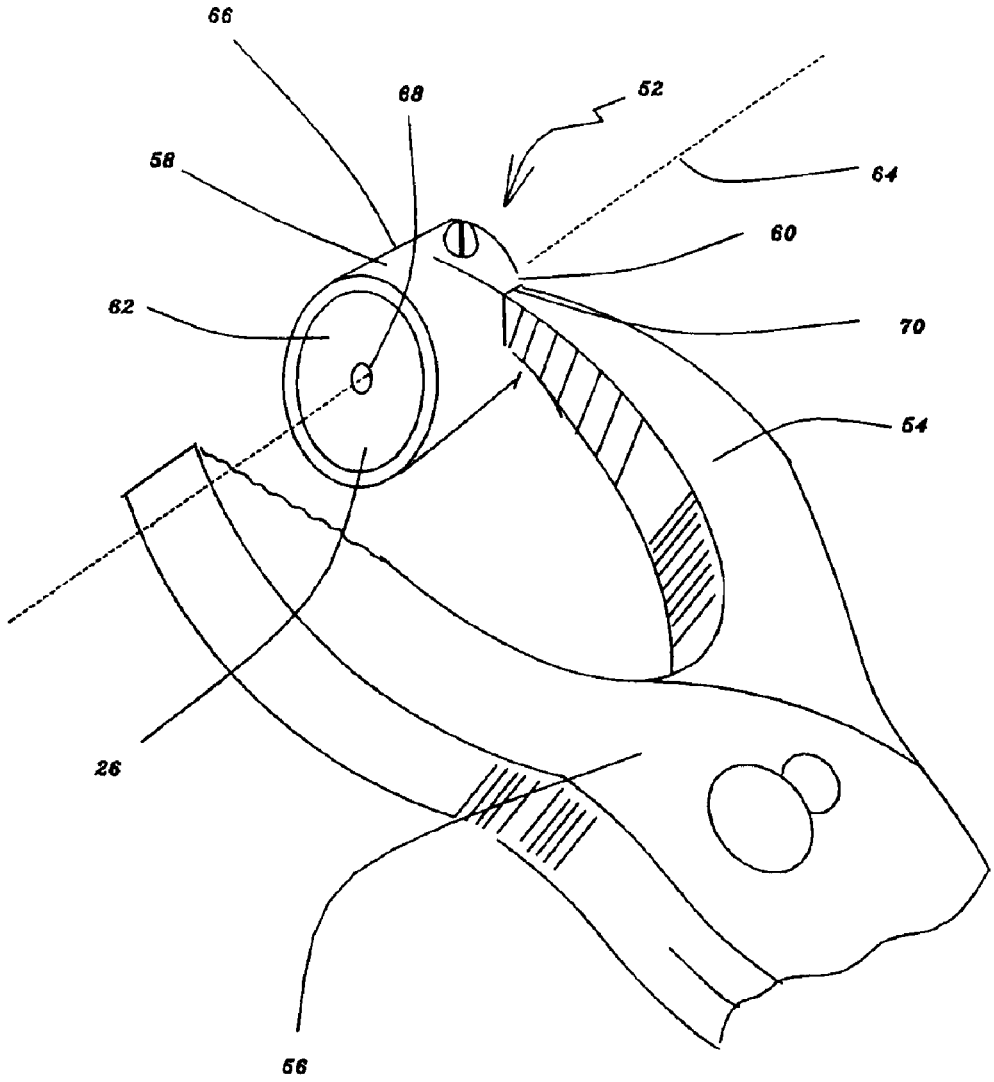
FIG. 7 is a perspective view of a tool device for attachment to a jaw of a pair of pliers for assisting fastening of a snap lock device of the present invention.

FIG. 7 is a perspective view of a tool device generally designated 52 for attachment to a jaw 54 of a pair of pliers 56 for assisting fastening of a snap lock device 10 of the aforementioned type. The tool device 52 includes a cylindrical member 58 having a first and a second face 60 and 62 respectively and a longitudinal axis 64 and a cylindrical outer surface 66. The cylindrical member 58 defines a coaxial bore 68 which extends between the first and second face 60 and 62.

Figure 8:
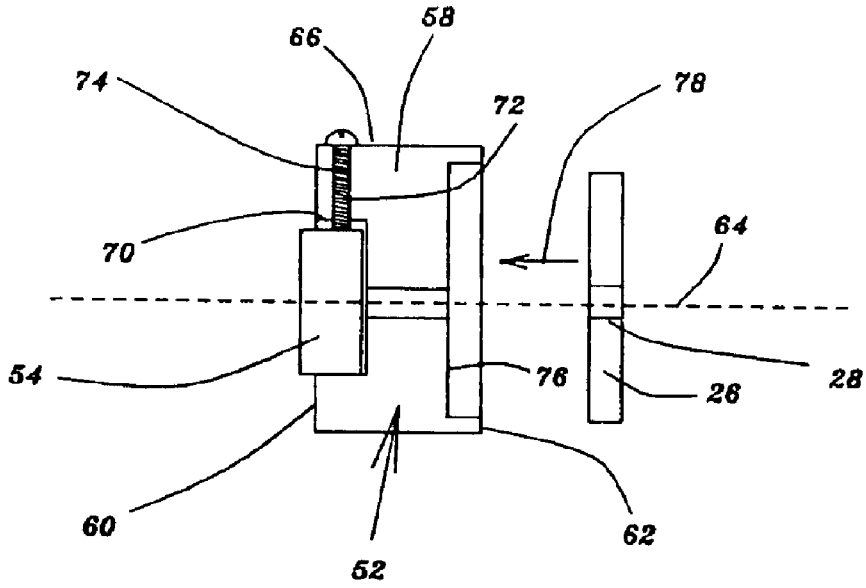
FIG. 8 is an enlarged side elevational view of the tool device shown in FIG. 7.

FIG. 8 is an enlarged side elevational view of the tool device 52 shown in FIG. 7. As shown in FIG. 8, the first face 60 defines a slot 70 which extends diametrically across the first face 60 for the reception therein of the jaw 54 of the pair of pliers 56. Also, the cylindrical member 58 defines a threaded bore 72 which extends normal to the slot 70, the threaded bore 72 extending from the cylindrical outer surface 66 to the slot 70. A fastener 74 cooperates with the threaded bore 72 such that the fastener 74 removably fastens the cylindrical member 58 to the jaw 54 of the pair of pliers 56.

Furthermore, the second face 62 of the cylindrical member 58 defines a cavity 76 which is disposed coaxially relative to the longitudinal axis 64. The cavity 76 has substantially the same dimensions as the second member 26. The arrangement is such that when a second member 26 is disposed within the cavity 76, as indicated by the arrow 78, insertion of the shank 20 within the aperture 28 of the second member 26 by the pliers 56 is permitted.

In operation of the device according to the present invention, an extension 12 is prepared by cutting a 3" by 3" square out of the top surface of the extension 12 with tin snips. Holes approximately ⅛" in diameter are drilled through the sides of the extension 12 below the removed square. The end of the downspout 14 is provided with corresponding holes aligned with the holes in the extension 12 so that a gap of ½" is left between the bottom of the extension 12 and the bottom of the downspout 14 for permitting pivoting of the extension 12 relative to the downspout. 14 The shank 20 of first member 16 is inserted into aligned holes of the extension 12 and the downspout 14. A Nylon second member 26 is then placed in the cavity 76 of the tool device 52. The other jaw of the pliers 56 is located against the head 18 of the first member 16 and the pliers 56 are then squeezed together so that the shank 20 extends through the bore 72 of the tool device and is guided through the aperture 28 of the second member 26. The ridge 50 is pushed through the aperture 28 and because of the natural resiliency of the NYLON disc 26, the disc 26 will be captured by the ridge 50 thus preventing the shank 20 from falling out of engagement with the aligned holes of the extension and downspout.

The operation is then repeated for the other side of the downspout 14 using the third and fourth members 30 and 40 respectively.

The present invention provides a unique and low cost device for hingedly securing an extension to a downspout.

What is claimed is:

1. A combination snap lock device, extension and downspout in which said snap lock device hingedly secures said extension to said downspout, said combination comprising:

a first member of said snap lock device;

said first member including:

a head;

a shank extending from said head, said shank extending through a first hole defined by said extension and through a second hole defined by said downspout;

a second member cooperating with said first member;

said second member defining an aperture for the locking reception therein of said shank for locking said extension and downspout together;

a third member;

said third member including:

a further head;

a further shank extending from said further head, said further shank extending through a third hole spaced from said first hole and defined by said extension and through a fourth hole spaced from said second hole and defined by said downspout;

a fourth member cooperating with said third member;

said fourth member defining a further aperture for the locking reception therein of said further shank for locking said extension and downspout together so that folding of said extension against said downspout is permitted for facilitating yard maintenance;

said shank defining an annular ridge such that when said shank extends through said aperture of said second member, said annular ridge locks said second member relative to said first member;

said head being of disc shaped configuration;

said head being fabricated from aluminum;

said shank being of cylindrical configuration;

said cylindrical shank having a proximal and a distal end and a cylindrical surface, said shank extending normal to said head;

said shank having a diameter which is less than a further diameter of said head;

said cylindrical surface defining said annular ridge such that when said shank extends through said aperture of said second member, said annular ridge locks said second member relative to said first member;

said second member being of disc shaped configuration;

said second member being fabricated from nylon; and said second member having a first diameter which is the same as said further diameter of said head.

2. A tool device, extension, and downspout for attachment to a jaw of a pair of pliers in combination with and for assisting fastening of a snap lock device as set forth in claim 1, said tool device comprising:

a cylindrical member having a first and a second face and a longitudinal axis and a cylindrical outer surface, said cylindrical member defining a coaxial bore extending between said first and second face;

said first face defining a slot which extends diametrically across said first face for the reception therein of the jaw of the pair of pliers;

said cylindrical member defining a threaded bore which extends normal to said slot, said threaded bore extending from said cylindrical outer surface to said slot;

a fastener cooperating with said threaded bore such that said fastener removably fastens said cylindrical member to the jaw of the pair of pliers;

said second face of said cylindrical member defining a cavity which is disposed coaxially relative to said longitudinal axis, said cavity having substantially the same dimensions as said second member, the arrangement being such that when a second member is disposed within said cavity, insertion of said shank within said aperture of said second member by the pliers is permitted.

* * * * *